United States Patent [19]

Schueler et al.

[11] 4,123,181

[45] Oct. 31, 1978

[54] ROADSIDE BARRIER MARKER SYSTEM

[75] Inventors: Arthur P. Schueler, Schaumburg; Robert I. Nagel, Skokie, both of Ill.

[73] Assignee: Astro Optics Corporation, Schaumburg, Ill.

[21] Appl. No.: 856,967

[22] Filed: Dec. 2, 1977

[51] Int. Cl.[2] ..... E01F 9/00

[52] U.S. Cl. ..... 404/9; 350/103; 404/16

[58] Field of Search ..... 404/9, 15, 16, 10, 14; 350/288, 299, 97, 102, 103

[56] References Cited

U.S. PATENT DOCUMENTS

| | | | |
|---|---|---|---|
| 2,318,722 | 5/1943 | Smith | 404/9 X |
| 2,329,171 | 9/1943 | Russ | 404/9 |
| 2,330,096 | 9/1943 | Waters | 404/9 X |
| 3,179,009 | 4/1965 | Sheffield | 404/16 |
| 3,485,148 | 12/1969 | Heenan | 404/16 X |
| 3,540,282 | 11/1970 | Kohler | 404/16 X |
| 3,901,614 | 8/1975 | Overacker | 404/16 |
| 3,905,679 | 9/1975 | Langenbach | 404/9 X |
| 3,905,680 | 9/1975 | Nagel | 404/9 X |
| 3,905,681 | 9/1975 | Nagel | 404/9 X |
| 4,035,059 | 7/1977 | DeMaster | 404/9 X |

*Primary Examiner*—Nile C. Byers, Jr.

*Attorney, Agent, or Firm*—Hill, Gross, Simpson, Van Santen, Steadman, Chiara & Simpson

[57] ABSTRACT

An improved roadside marker system wherein each individual reflector means is continuously visible by the driver of a vehicle moving along the roads surface at night-time from an angle of 0° to 60° where 0° extends substantially parallelly to a tangent to the road side portion in the region where each respective one of the reflector means is located. Also, such driver continuously sees retroreflected light at any given instant of time while approaching and passing a group of the reflector means so employed and so located.

21 Claims, 19 Drawing Figures

31
33
37
32
34
38
40
30
60E
60D
31'
37'
32'
60C
60B
38'
40'
30'
20
21
28
25
35
22
27
23
26
24
36
29
41
20'
60
40'
60A
28'
25'
21'
35'
27'
26'
23'
24'
36'
29'

ROADSIDE BARRIER MARKER SYSTEM

BACKGROUND OF THE INVENTION

Heretofore, in order to mark or delineate for visibility at night time by vehicle drivers road side edge portions (or road side edge barriers, or road median strips delineating the space interval between two adjacent highway surfaces running parallelly to one another, or curved exit or entrance ramps associated with so-called super highways and other roadways, or tunnels, or bridge structures, or any harzardous object along a road), it has been conventional to employ vertically oriented reflectors. In general, three types of prior art reflectors have been employed for this class of application: (1) the prismatic triple mirror type reflector using a plurality of standard reflex type units wherein the individual cube axes are perpendicular to the surface of the reflector; (2) the glass bead-type reflector sheeting wherein glass beads are embedded thereinto; and (3) the prismatic triple mirror type reflector using a plurality of angled cube corner-type retroreflective units (such as a reflector adapted from the teachings of Heenan U.S. Pat. No. 3,332,327) which is normally mounted horizontally on the pavement as a center line marker or the like, but which in this application is mounted vertically and which here employs only the front ramp-like surface of such reflector body). In this class of application, the performance of all three of these reflectors is similar to one another in that the peak of retroreflectivity of each type in terms of light intensity when such is so mounted upon a road side edge or the like in a vertical orientation is parallel to a tangent to the road at that point. Retroreflectivity extends from that parallel position (sometimes termed 0°), or from a peak intensity location, through typically angles up to about 25° to 30° into the roadway, although the glass bead-type reflector sheeting appears to have slightly more angular range than this, going up to perhaps about 40°.

In all known such prior art types of reflectors adapted for this class of application, the reflected light output, or performance of retroreflectivity, decreases with increasing angles to such tangent to the road. This decrease is such that, as a car moves down a roadway at night, for example, the driver has each individual road side reflector in view (as respects retroreflected light) only through a maximum angle typically not greater than about 30°. For the rest of the time interval that the driver is before and approaching an individual reflector (which thus covers an angular range or zone of from about 30° to 90°), the driver is unable to see the individual reflector by retroreflected light because such reflector is not retroreflective of the car headlights in that zone. Perhaps the driver can physically see an individual such reflector, but once the driver is beyond 30°, and in the range of from 30° to 90°, he can not see or receive any retroreflected light signal therefrom.

This limitation on retroreflective viewability causes serious night-time motorist hazards espcially on curved roads since a driver is unable to see a curve ahead, or a significant distance along a curve ahead, as he proceeds to drive along a road. What occurs is that the driver's line of sight as he proceeds to drive along the road enters the non-reflected zone in a very brief distance since the tangent to the curve in the road curve inherently has a continuously greater angle with increases in road curvature. Therefore, as the driver proceeds along a roadway which has an increasing degree of curvature with distance along the road, the driver has increasingly less delineation of the highway ahead owing to the inherent limitations of such prior art retroreflectors used for road edge delineation. This limitation is most particularly evident on exit and entrance ramps of limited access roads which ramps are extremely curved in relation to the normal road pathway connected with such a ramp.

For example, in a modern cloverleaf road interchange, where a main highway may over-cross an intersecting road via an overpass, the intersecting road is connected with the main road through a system of connecting roads called a cloverleaf. Thus, at the overpass, the main highway employs a bridge-type construction. Normally, on such a bridge-type construction, the median portion between the two oppposing directions of traffic on the main highway is an upright construction or supporting structure presenting a potentially dangerous hazard to a car which is entering the main highway from the intersecting road via one of the cloverleaf entrance roads. By nature of the shape of the individual cloverleaf road ramps, an entering car approaches the hazardous median at an angle which typically may be between 45' and 70°. When delineated by such prior art reflector devices, the median reflectors are visible in advance to drivers proceeding in either direction along the main highway, but the median is not visible to the drivers approaching and entering into the main roadway from a cloverleaf road ramp, since, to such entering drivers, the angle of viewing of the median reflectors is beyond the retroreflectivity characteristics and capabilities of the median reflectors.

For another example, a similar situation exists with respect to cars exiting from such a main highway onto such a cloverleaf road ramp so as to enter upon such an intersecting road. In this case, the degree of curvature of the cloverleaf road ramp is so great that the prior art reflectors, when duly mounted so that the peak of retroreflectivity is parallel to the tangent to the curve of the road ramp, have a retroreflective viewing angle which increases rapidly with the curvature of the road and therefore permits a driver entering or on a road ramp to see simultaneously only a very limited number of such prior art reflectors for delineating the curve ahead since the driver's line of sight is beyond the zone of retroreflectivity associated with individual reflectors spaced and mounted along the roadway edge of the ramp.

From such examples, it is seen that there is a need for an improved roadside reflector system which will permit the drivers of vehicles to see individual roadside reflectors for a considerable distance along a road ahead. Such retroreflective viewability requires individual reflectors each of whose retroreflectivity characteristics extend from about 0° up to at least about 60° and these reflectors are then stationed at desired intervals along road side edge portions.

So far as is known, nothing in the prior art in any way teaches or suggests roadway edge marking reflector systems adapted to provide appreciable, or practically sufficient, retroreflectivity beyond about 30° so that the zone of from 30° to 60° is actually completely uncovered by prior art roadside reflector systems. As indicated, between about 30° and 40°, some retroreflectivity is provided by glass beaded reflectors (for example, a glass beaded sheet the so-called "Scotch-Light" (trademark) type available from Minnesota Mining & Manufacturing Company, St. Paul, Minn., but the 10° wide zone from 30° to 40° is found to be only weakly retroreflective for such glass beaded sheeting so that the viewability and the retroreflectivity characteristics of glass beaded sheeting is generally considered by those skilled in the art of highway marking to be insufficient for adequate highway safety practices at these angles of from 30° to 40°. Currently, glass beaded reflectors are accepted as a 0° to about 25° material, and very little use is made of the retroreflectivity characteristics of glass beads in the range of from about 25° to 40° because of this inherent weakness. Thus, no known roads have ever been equipped with reflector constructions at spaced intervals along roadside edge portions such that individual reflectors provided vehicle drivers moving along the road with continuous reflectivity, from individual reflectors ranging at least from 0° to 60°.

Consequently, there is a great need in the field of road safety for a barrier marker system in which individual reflectors retroreflect through angles of from at least about 0° to at least about 60° and preferably from about minus 5° to plus 75° relating to a road in order to cover the various approach angles inherently associated with vehicular operation along roadways at night time.

While, as indicated, no known individual reflector constructions adapted for this class of application have continuous retroreflective viewability characteristics over such ranges (relative to a road), cube corner type retroreflector constructions having retroreflective continuous viewability characteristics over a range of from about 0° to 70° (measured in the same relative direction as that herein used in reference to the present class of application) have heretofore been known to the prior art, but have been employed in, and developed for, other fields of application. For examples, see Heenan et al. U.S. Pat. No. 3,887,268, Heenan et al. U.S. Pat. No. 3,541,606; Golden et al. U.S. Pat. No. 3,887,268; Nagel U.S. Pat. No. 3,893,747; Nagel U.S. Pat. No. 3,894,786; Golden et al. U.S. Pat. No. 3,894,790; Nagel U.S. Pat. No. 3,895,855; Nagel U.S. Pat. No. 3,905,680; Nagel U.S. Pat. No. 3,905,681; and the like. Commonly even when prior reflectors have retroreflective capability through includes angles greater ±30° such are not adapted for use in the highway marking field. For one thing, such prior art reflectors could have reflective characteristics which go so far beyond an included angle of 90° that they become safety hazzards in that they could equally guide motorists approaching the same point from opposed directions. Observe also that, for example, even if one endeavours to move a reflector of the type shown in Heenan U.S. Pat. No. 3,332,327 to an elevated position along the side of a road, one still does not obtain continuous retroreflectivity from such a reflector through an angle of from 0° to 60°. In the highway barrier marker field, reflector constructions specially adapted for positioning and mounting along road side edge portions are needed and necessary in order to permit economical installation, low maintenance costs, long life, good reflectance characteristics over the ranges desired (as above indicated), and the like. New and improved reflector constructions which are specially adapted for this class of application are thus needed.

BRIEF SUMMARY OF THE INVENTION

More specifically, the present invention relates to a roadway construction of the conventional type having generally longitudinally extending road surface portions with road side edge portions. Sometimes, markers, barriers, or equivalent impediments are located alongside of the longitudinally extending portions. Such a roadway, in accord with one aspect of the present invention, is equipped with a plurality of road edge reflector means which are each adapted to be continuously visible to drivers of vehicles moving along the road through an angle of from about 0 to at least about 60°but less than about 90°.

Each one of these individual retroreflective reflector means utilized has at least two regions thereof which are each retroreflective of incident light. Each such region has at least one flattened exterior surface portion which is inclined angularly relative to the other thereof. Each region is colored white, red, amber or blue. Also, together these regions are interrelated so that they are continuously retroreflective of incident light rays striking its such two regions over a predeterminable included angle which is at least about 60° but less than about 90° measured outwardly from one such flattened exterior surface portion. Such retroreflected light from each of such reflector means at any given location within such included angle has a minimum specific intensity value for retroreflectivity which is at least that shown in the following table:

TABLE 1

| Color of such one region | Specific intensity value in candelas per foot candle |
|---|---|
| White | 20 |
| Red | 5 |
| Amber | 12 |
| Blue | 5 |

In addition, the invention employs a plurality of mounting means. Each individual mounting means is associated with a different respective one of the indicated reflector means. Each such mounting means holds its associated such respective reflector means in a predetermined orientation and in a predetermined region relative to such roadway construction that the following relationships are maintained:

1. Such one flattened surface portion is generally vertical;
2. Such one flattened surface portion is so positioned to the road side edge portions or to longitudinally extending road surface portions that, in relation to an included angle of 60°, 0° thereof extends substantially parallelly to a tangent to one of said road side edge portions (or to longitudinally extending road surface portions, as the case may be) in such region where each respective one of such reflector means is so held;
3. Individual ones of such reflector means are in longitudinally spaced relationship relative to one another longitudinally along such roadway construction; and
4. Each respective one of such reflector means of such plurality thereof is located relative to such roadway construction in a similar spatial position.

Preferably, and typically such individual reflector means are located in spaced relationship to the surface portions of a given roadway construction, heights of from about 6 inches to 60 inches being typical, with many conventional prior art reflectors.

The interrelationship between such plurality of reflector means and such road surface portions is such that the driver of a vehicle moving along such road surface portions at night-time, such vehicle being equipped with headlight means, can continuously see each individual reflector means within a viewing angle of from about 0° to at least about 60°, but less that 90°, where 0° extends substantially parallelly to a tangent to one of said roadside portions in the region where such reflector means is mounted and where 60° and 90° extends outwardly into such road surface portions from such a tangent. Preferably, such continuous individual reflector vision extends from about −5° to 75°.

A primary object of the present invention is to provide a new and improved safety system for highway barrier marking which utilizes reflectors that can be continuously seen individually not only through angles of from about 0° to 30°, as in the prior art, but which can also be continuously seen at angles from about 25° to 30° up to at least about 60°, and which can preferably be seen continuously at angles of from about −5° to 75°, but less than about 90°.

A further object of this invention is to provide improved reflector constructions and arrangements particularly well suited for use in the practice of the improved safety system of the present invention.

A further object is to provide an improved reflector system which creates better (relative to prior art) road delineation characteristics for both straight and curved vehicular roads, such system being particularly well adapted for use with highway systems of the so-called modern super highway type having roadside barriers, and the like.

Another object of this invention is to provide a system of the class indicated above which is simple, efficient, reliable, economical, and long lasting which uses reflectors that are adapted for use with existing and available roadside mounting means.

Sometimes a given roadway construction can have two or more pluralities of reflector means (and associated mounting means); for example, one plurality can be on an inside portion, the second on an outside portion of a given roadway construction.

Other and further objects, aims, purposes, features, advantages, modes, applications, variations, and the like will be apparent to those skilled in the art from the teachings of the present specification taken together with the drawings.

DETAILED DESCRIPTION

Figures 1, 2, 3:
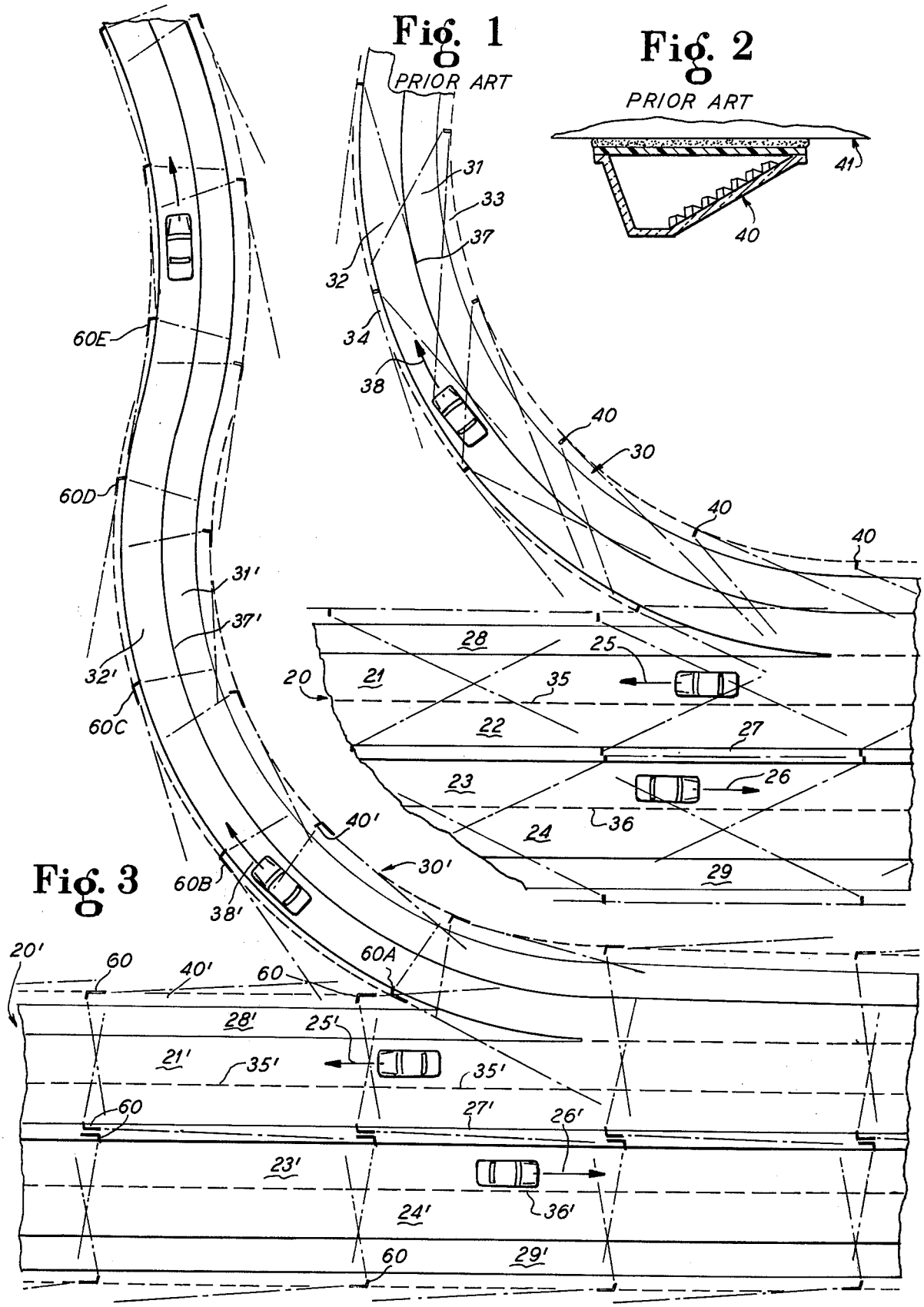
Fig. 1 PRIOR ART
Fig. 2 PRIOR ART
FIG. 1 is a diagrammatic partial view of a road equipped with prior art type road side barrier markers illustrating the type of pattern of retroreflected light from such markers seen by vehicle drivers traversing such road in the night time.
FIG. 2 is a transverse sectional view taken through a mid-region of a prior art barrier marker embodiment.
FIG. 3 is a view similar to FIG. 1 but showing another such road equipped with road side barrier markers of the present invention.
Figure 4:
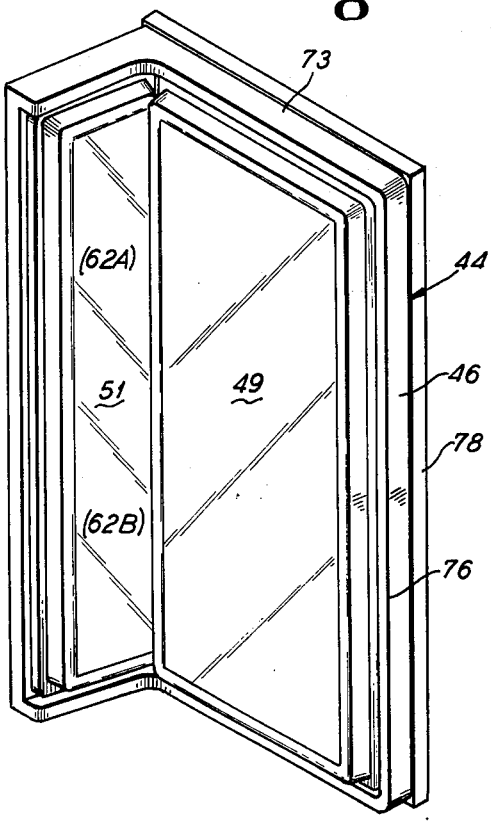
FIG. 4 is an isometric-type view of one embodiment of a road side barrier marker of the present invention.
Figure 5:
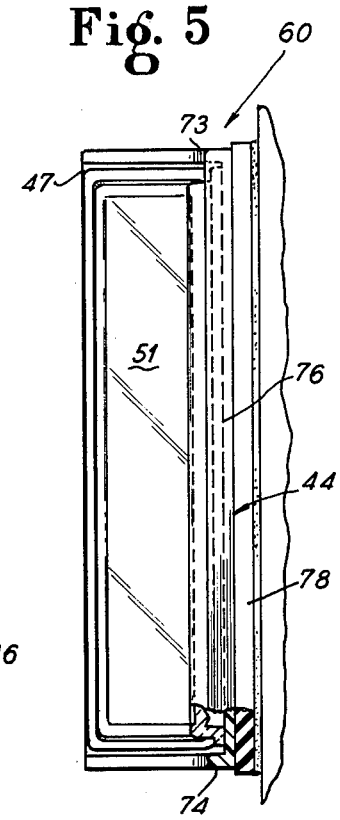
FIG. 5 is an end elevational view of the barrier marker embodiment shown in FIG. 4, showing such embodiment mounted upon a surface.
Figure 7:
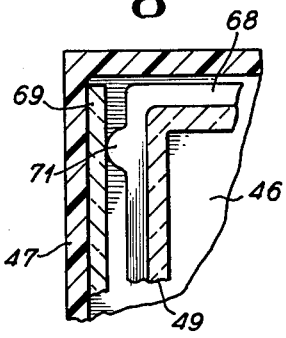
FIG. 7 is an enlarged fragmentary sectional view taken through the region VII—VII of FIG. 6.
Figure 6:
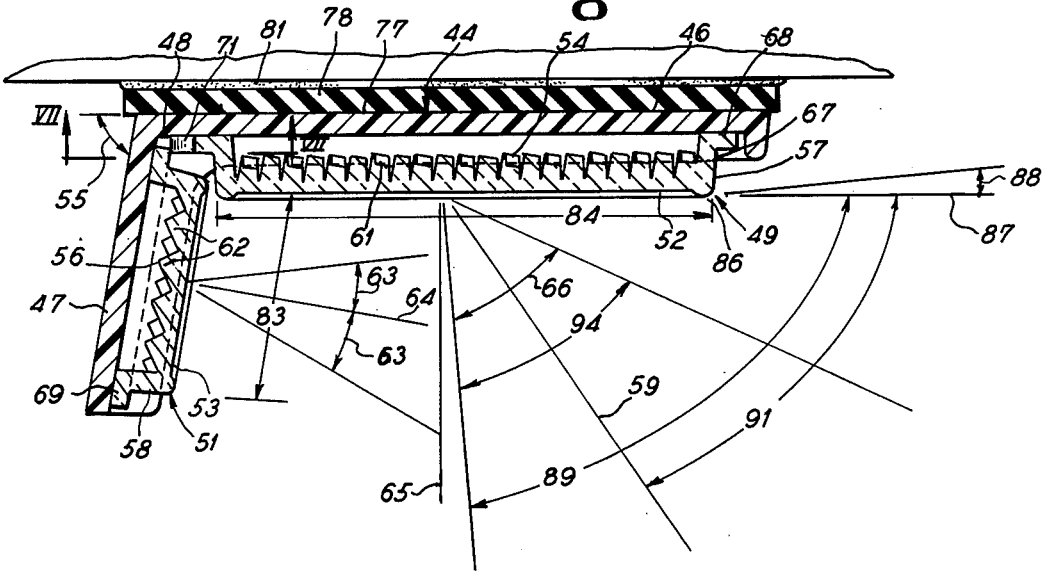
FIG. 6 is a transverse sectional view taken through a mid region of the barrier marker embodiment shown in FIG. 4.

Referring to FIG. 1, there is seen, for present illustrative purposes, a fragment of a modern divided highway construction 20, sometimes referred to as a super highway, comprised of four paved lanes 21, 22, 23, and 24. Lanes 21 and 22 accommodate vehicular traffic moving in this drawing to the left, as indicated by the car and arrow 25, while lanes 23 and 24 accommodate vehicular traffic moving to the right as illustrated by the car and arrow 26. The lanes 21 and 22 are separated from the lanes 23 and 24 by an upstanding concrete barrier wall 27 (or the like) which extends longitudinally between the lanes 22 and 23. Dotted line 35 here delineates contiguous lanes 21 and 22 and dotted lines 36 here delineates contiguous lanes 23 and 24. On the outside of the lane 21, a shoulder 28 (paved) is provided, and on the outside of lane 24 a shoulder 29 (paved) is provided. Highway 20 is of the type designed for limited vehicular access. The portion of highway 20 shown includes a fragment of an exit ramp 30 of a so-called scissors type upon which exiting traffic may leave highway 20 without stopping from lane 21 while decelerating. The movement of traffic along exit ramp 30 is designated by the illustrative car and arrow 38. Ramp 30 is here comprised of one lane 32 with an adjacent contiguous shoulder 31; road edge 37 separates these regions of FIG. 1. Areas 33 and 34 are provided along opposing side edge portions of road 30 and in these areas barrier markers are provided.

Highway 20 and ramp 30 are each provided and equipped with prior art type longitudinally spaced (relative to highway 20 and ramp 30) reflectorized barrier or road edge markers which are each for convenience herein designated by the numeral 40. The reflectors 40 are located along roadside edge portions. Thus, the reflectors 40 are located in longitudinally spaced relationship to one another along the edge portions of the respective shoulders 28 and 29 and 33 and 34. In addition, opposed side wall portions of the barrier wall 27 are provided at longitudinally spaced intervals with reflctors 40 (see FIG. 2).

Such a prior art reflector 40 is adapted to retroreflect light only through a maximum angle typically not greater than about 30°. The included angle of retroreflectivity for each reflector 40 is so arranged (by orienting each reflector 40 relative to highway 20 and ramp 30) that retroreflectivity extends generally from a position parallel to a tangent to the road edge at the location of an individual reflector 40 out into the roadway at an angle of about 25° to 30° maximum. Each of the reflectors 40 illustrated in FIG. 1 along the highway 20 and the ramp 30 is provided with a pair of intersecting broken lines to illustrate an included 30° angle through which light is retroreflected as respects incident rays striking retroreflective portions of an individual reflector 40. As can be seen, the driver of each of the vehicles 25, 26, and 38 is able to view each individual roadside reflector 40 (as respects retroreflected light) only through a maximum angle typically not greater than about 30°, from a tangent to the roadway at the mounting portion of the reflector. For the rest of the time interval that each respective such driver of vehicles 25, 26, and 31 is before and approaching an individual reflector 40 (which time interval thus covers an angular range or zone of from about 30° to 90° relative to each individual reflector 40), the driver of the individual vehicles 25, 26 and 31 is unable to see the individual reflectors 40 by retroreflected light because such individual reflectors 40 are not retroreflective of the car headlights in that zone.

In additon, it is a further characteristic of such prior art reflectors 40 that reflected light output, or performance of retroreflectivity, decreases with increasing angles from 0° (or the tangent to the roadway). In other words, the amount of light that the driver of a vehicle 25, 26, or 31 sees as he moves his vehicle down a lane such as 32, 21, or 23 continuously declines from an individual retroreflector 40 as the angle of viewing of each individual reflector 40 increases towards 25° or 30° when each reflector 40 becomes invisible to a driver as respects retroreflected light.

As a consequence of the above characteristics, a driver's field of view as he proceeds along a road equipped with prior art reflectors 40 is such that a non-reflectorized zone in this field of view is entered regularly at very brief distances and intervals along the road corresponding to individual reflectors. Thus, when a driver is proceeding down a straight road, a blinking or fluttering light pattern is produced from individual reflectors 40 when a driver is proceeding along a road, particularly along a curved roadway which has an increasing degree of curvature with increasing distance along the road. Consequently, a driver has increasingly less delineation of a road ahead in the curved road situation owing to the inherent limitations of such prior art retroreflectors. Such limitations on retroreflective viewability cause serious night time motorist hazards.

To overcome such hazards, the present invention provides a roadside barrier marker system employing cube corner type retroreflectors which retroreflect continuously through an angle of at least about 60° from 0° (located parallelly to a road). Reflectors used in the system of the present invention are so constructed, mounted and oriented relative to a given road that the driver of a vehicle moving along such road equipped with headlight means can continuously see individual reflector means within a viewing line angle of from about 0° to 60°, where 0° extends substantially parallelly to a tangent to one of the roadside edge portions in the region where the reflector is mounted.

One exemplary embodiment of a barrier marker system of the present invention is illustrated in FIG. 3 wherein is shown a modern divided highway construction which is similar to that shown in FIG. 1 and described above. For reasons of convenience and brevity, similar elements in FIG. 3 corresponding to those in FIG. 1 are similarly numbered but with the addition of prime marks thereto. Here, highway 20' and ramp 30' are each provided and equipped with reflectorized barrier or road edge markers which are each for conveninece herein entirely designated by the numeral 60. Like the reflectors 40, the reflectors 60 are located along road side edge portions in substitution for the individual positions occupied by the reflectors 40.

Each reflector 60 is adapted to retroreflect light through a maximum angle ranging at least from about −5° through about 75°. The included angle of retroreflectivity for each reflector 60 is so arranged (by orienting each reflector 60 relative to highway 20' and ramp 30') that retroreflectivity extends generally from a position approximately 5° to the outside of a tangent to the road at an angle of about 75° maximum. Each of the reflectors 60 illustrated in FIG. 2 along the highway 20' and the ramp 30' is provided with a pair of intersecting broken lines to illustrate an included angle of 80° through which light is retroreflected as respects incident rays striking retroreflective portions of an individual reflector 60. As can be seen, the driver of each of the vehicles 25', 26' and 31' is able to view each individual road side reflector 60 (as respects retroreflected light) through a maximum angle typically greater than about 80°. Thus each such driver continuously is able to see by retroreflected light each individual reflector 60 during the entire time interval that the respective vehicle involved remain behind and approaching an individual reflector 60.

The candela per foot candle signal that the driver of a vehicle 25', 26' or 38' sees as he moves his vehicle down a lane such as 32', 21' or 23' remains relatively constant, particularly in the angular range between about 0° and 60°.

As a consequence of the above characteristics, a driver's field of view as he proceeds along a road equipped with the reflector 60 is such that no non-reflectorized zone in this field of view is entered for an individual reflector as a vehicle such as 38', 25' or 26' moves down the road until such vehicle nears an angle of 90° with respect to an individual reflector 60 adjacent thereto, respectively. Thus, the limitations on retroreflective viewability associated with prior art reflectors 40 is substantially completely eliminated.

One exemplary embodiment of a reflector construction suitable for use in the practice of the present invention is shown in FIGS. 4 through 7 and is designated in its entirety by the numeral 60. Reflector construction 60 is provided with a backing member 44 of integral one-piece rigid construction. The backing member 44 has a base portion 46 which is flattened and an inclined (relative to base portion 46) leg portion 47 which is likewise flattened. Leg portion 47 upstands along one edge 48 of the base portion 46, and is canted in relation to the base portion 46 preferably at an angle 55 ranging from about 75° to 85°; and broadly at an angle of from about 60° to 85°. In reflector 60, angle 55 is 80° which is presently a most preferred angle. The backing member 44 is preferably comprised of a molded plastic, such as ABS, nylon, polyester, or the like, but may be formed of sheet metal, or the like if desired.

Reflector construction 60 incorporates two molded transparent retroreflective flattened rectangularly shaped bodies 49 and 51. Each body 49 and 51 has a flattened outer face 52 and 53 respectively, as well as an inner face 54 and 56, respectively. Each inner face has formed thereinto a plurality of individual cube corner type retroreflective units 61 and 62, respectively. All units 61 in inner face 54 are arranged so as to be generally coplanar relative to one another, and similarly for all the units 62 in inner face 56, respectively. An inturned peripheral shoulder 57 and 58, respectively, extends about each body 49 and 51, and projects beyond its respective associated inner face 54 and 56. Each such shoulder 57 and 58 terminates in an outturned flange 68 and 69, respectively. Preferably, both bodies 49 and 51 have the same color.

Bodies 49 and 51 have their respective flanges 68 and 69 positioned against and mounted to base 46 and leg 47 of backing member 44, respectively. Any convenient mounting means for bodies 49 and 51 may be employed, such as an adhesive, or the like, but here ultrasonic welding is employed preferentially and as shown in the Figures. In assembly body 51 is first mounted to leg 47 and the body 49 is mounted to base 46. Flange 68 is provided with a spacing ear 71 integrally formed therewith which serves to locate and orient body 49 relative to backing member 44 and body 51 in a desired manner before ultrasonic welding (see FIG. 7).

Upstanding from the opposed sides of base 46 and leg 47 is an integrally formed rib 73 and 74, respectively and upstanding from the forward edge of base 46 is an integrally formed rib 76. Ribs 73, 76 and 74 are joined end to end with one another integrally. Ribs 73, 74 and 76 rigidify and strengthen backing member 74 and aid in protecting edge portions of bodies 49 and 51 from bumps or impacts.

The nature and construction of cube corner type retroreflective units and reflectors utilizing same is well known; see, for instance, the disclosure contained in U.S. Pat. Nos. 3,894,786 or 3,893,747, or that in the Heenan and Nagel U.S. Pat. No. 3,541,606.

In reflector 60 when angle 55 is in the preferred range above indicated, the cube corner units 62 of retroreflective body 51 are preferably of the so-called standard type. Thus, the respective optical axes (not detailed) of the individual respective units 62 are preferably normal to the outer face 53 thereof, and retroreflective body 51 is adapted to retroreflect light rays incident against face 53 through cone angle 63 of up to about 25° to 30° around a perpendicular 64 to face 53, as those skilled in the art will appreciate. Broadly, the cube corner retroreflective units in body 51 have optical axes parallel to one another and extending at an angle of from about 0° to 15° with respect to a perpendicular 64 to the face 53 of body 51 and retroreflective body 51 is adapted to retroreflect light rays incident against face 53 up to about 50° relative to one side of the perpendicular 64.

In order to minimize the characteristic so-called clover-leaf pattern of retroreflection associated with retroreflection from a group of standard cube corner units which are all similar oriented, it is preferred, but not necessary to divide the units 62 into two equal groups, and to rotate the axes of the units of one group 180° with respect to the axes of the units of the other group. In retroreflective body 51, such a grouping is used so that one group 62A is formed in the inner face 56 in the upper half of the body 51 as shown in FIG. 1 while the other group 62B is formed in the inner face 56 in the lower half of the body 51 as shown in FIG. 1.

Also, in reflector 60, the cube corner units 61 of retroreflective body 49 are preferably of the so-called wide angle type. Thus, the respective optical axes illustrated by line 59 of the individual respective units 61 are inclined at an angle 66 of from about 20° to 35° (preferably 25° to 30°) with respect to a perpendicular 65 to outer face 52 of flattened retroreflective body 49. Thus, light rays within an included angle 94 of from about 65° to 75° to one side of perpendicular 65 to about 5° to 15° to the same side of perpendicular 65 striking face 52 are retroreflected. The orientation of angle 94 is such that the location of its greatest lateral or side projection is towards side 67 of body 49. Thus, when body 49 is mounted on base 46, as shown, for example, in FIGS. 4 and 6, the orientation of body 49 is such that body 49 is retroreflective of incident light rays moving against face 52 from locations lateral and outside of side 67 and from directions generally opposite to those from opposed locations beyond leg 47 and body 51.

One method of mounting the reflector is the use, over the back surface 77 of base 46, of an adhesive layer 78, comprised of, for example, a butyl rubber based pressure sensitive adhesive tape, or the like. Until the time of application, the exposed surface of layer 78 can be covered by a coated paper release sheet or equivalent, if desired (removed and not shown). Layer 81 is an optional but not preferred adhesive cushioning layer. Other methods of mounting include use of epoxy resin or air curing adhesive directly between surface 77 and the surface to which the reflector is to be mounted. Mechanical mounting means (not shown) could be used if desired.

In a given reflector 60, the interrelationship between the vetical height 83 of body 51 above the face 52 of body 49 and the transverse distance 84 across the face 52 of body 49 is such that preferably a minimum predetermined specific intensity value for retroreflectivity in candelas per foot candle exists for reflector 60 with respect to incident and retroreflected light passing the forward tip edge 86 of body 49 at or along a negative angle 88 of predetermined value (such as −5°) relative to a tangent line 87 extending parallel to the surface of face 52 but perpendicularly to side 67 of body 49 which tangent line represents 0°. The exact angle (not shown) at which, for example, incident light rays at some predetermined such negative angle 88 strike the face 53 is unimportant so long as such minimum predetermined specific intensity value is achieved in fact, as those skilled in the art will understand. For example, at a negative angle 88 of −5° (presently preferred), a reflector 60 preferably has a minimum specific intensity value for retroreflectivity which is at least that shown in the following table:

TABLE II

| Color of bodies 49 and 51 | Specific intensity value in candelas per foot candle |
|---|---|
| White | 10 |

TABLE II-continued

| Color of bodies 49 and 51 | Specific intensity value in candelas per foot candle |
|---|---|
| Red | 2.5 |
| Amber | 6 |
| Blue | 2.5 |

Also preferably in such a given reflector 60, at an angle 89 of predetermined value above 60°, but less than 90°, measured perpendicularly to tangent line 87 and to side 67 of body 49, a minimum predetermined specific intensity value for retroreflectivity in candelas per foot candle exists for reflector 60 with respect to incident and retroreflected light at or along such angle 89. For example, at a positive angle 89 of 75° (presently preferred), a reflector 60 preferably has a minimum specific intensity value for retroreflectivity which is at least that shown in the following table:

TABLE III

| Color of Bodies 49 and 51 | Specific intensity value in candelas per foot candle |
|---|---|
| White | 10 |
| Red | 2.5 |
| Amber | 6 |
| Blue | 2.5 |

In general, the relationship between the bodies 49 and 51 in a reflector 60 is so selected that between the 0° tangent line 87 and an angle 91 of 60° measured perpendicularly to tangent line 87 and to side 67 of body 49 reflector 60 is continuously retroreflective of incident light rays striking one or the other of faces 52 and 53 and such retroreflected light has a minimum intensity value as set forth in Table 1 above. Preferably, such a reflector 60 is continuously so retroreflective of incident light rays between −5 and 75° (measured relative to tangent line 87) so that Tables I, II and III are satisfied.

Figure 8:
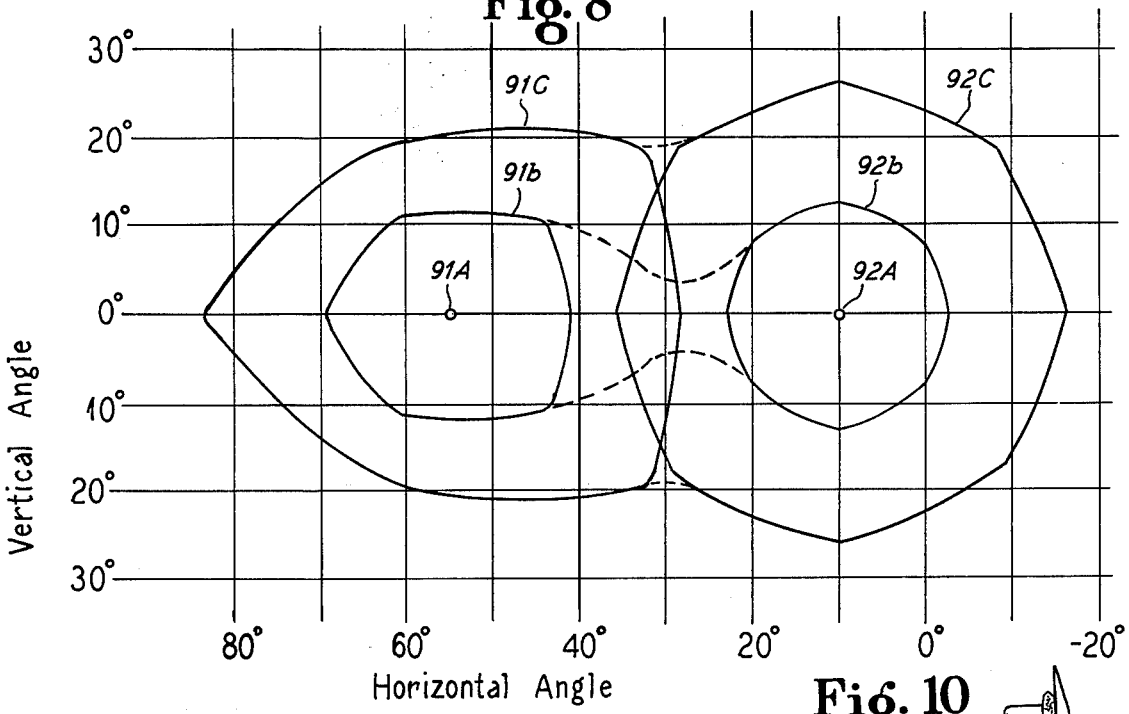
FIG. 8 is a plot in rectangular coordinates illustrating the manner in which light is retroreflected from respective ones of the reflector-equipped surfaces utilized in the barrier marker embodiment of FIG. 4.

In FIG. 8 there is shown a representative plot in rectangular coordinates illustrating characteristic specific intensity values of retroreflected light from each of the bodies 49 and 51 of a reflector 60 at each of several different retroreflective light values, respectively. Thus, curves 91A, 91B, and 91C are representative of retroreflected light from body 49 at respective percentages of 100%, 30% and 10%, and curves 92A, 92B and 92C are representative at respective percentages of 100%, 30% and 10% of retroreflected light from body 51. Curves 91A and 92A are each a point. The retroreflection from each respective body 49 and 51 adds together in use of a reflector 60 producing composite curves connected by dotted lines in FIG. 8. Observe that the intersection of 0° horizontal angle represents the direction parallel to the tangent to the roadway at the point at which the reflector 60 is mounted, it must be remembered that the reflector 51, here with standard cube corner optics of the cube corner type has been tilted 10° from the perpendicular to the roadway.

When reflector 60 is mounted with layer 78 against the surface of a support 82, such as a guard fence, post, or the like, as desired, reflector 60 thus becomes mounted in a permanent manner resistant to attack by weather, and the environment. When being mounted, reflector 60 is spatially oriented so that face 52 is generally parallel to a tangent to an adjacent roadway side edge portion while side 67 is generally perpendicular to the surface of the adjacent roadway. Thus, reflector 60 as so mounted is viewable by the driver of a vehicle moving along such roadway continuously through an angle of from at least about −5° to 75° in relation to such tangent.

When reflector 60 is so mounted relative to a roadway, body 51 is facing substantially towards on-coming traffic but is tilted preferably about 10° into a roadway. Since body 51 incorporates standard retroreflective optical elements preferentially, there is thus approximately 25° of reflectivity on each side of a perpendicular to the face 53 so that the body 51 covers from about −15° to +35°, such angles being measured from a direction parallel to the tangent to the roadway at the point where each reflector 60 is mounted. Because the body 49 incorporates so-called wide angle cube corner type retroreflective optical units, and because the body 49 is mounted in a direction parallel to the flow of traffic, the wide angle optics peak at approximately 35° to a normal or perpendicular to face 52 or approximately 55° from such tangent to such roadway. Reflection thus occurs predominantly in the region from + or − 25° from such a 35° peak. Hence, while the standard units 62 are active to an angle of 35° into a roadway, the wide angle units 61 commence to become active at an angle of about 30° from the tangent to the roadway resulting in an approximate 5° overlap between the respective retroreflected light from body 49 and body 51. On an opposite side, the body 52 retroreflects 25° from the peak which is about 35° from a normal to the face 52 so therefore the body 49 is active to about 80° from the direction of the tangent to the roadway at the point where each reflector 60 is mounted approximately. Thus, the combined standard and wide angle reflectors such as 51 and 49 employed in a preferred embodiment of reflector 60 are active from about −15° to such tangent to the roadway through an angle of about +80° to such tangent in a particularly preferred embodiment.

For a given reflector 60, duly mounted along the side of a road as on a barrier or the like, the distance from a car moving along the road towards the reflector can be regarded as one leg of a triangle, and the distance from the car to the barrier can be regarded as another leg of the triangle. Thus, for various distances a number of triangles can be created, each triangle including an entrance angle. A value can be established for the specific intensity at a given entrance angle.

Figure 16:
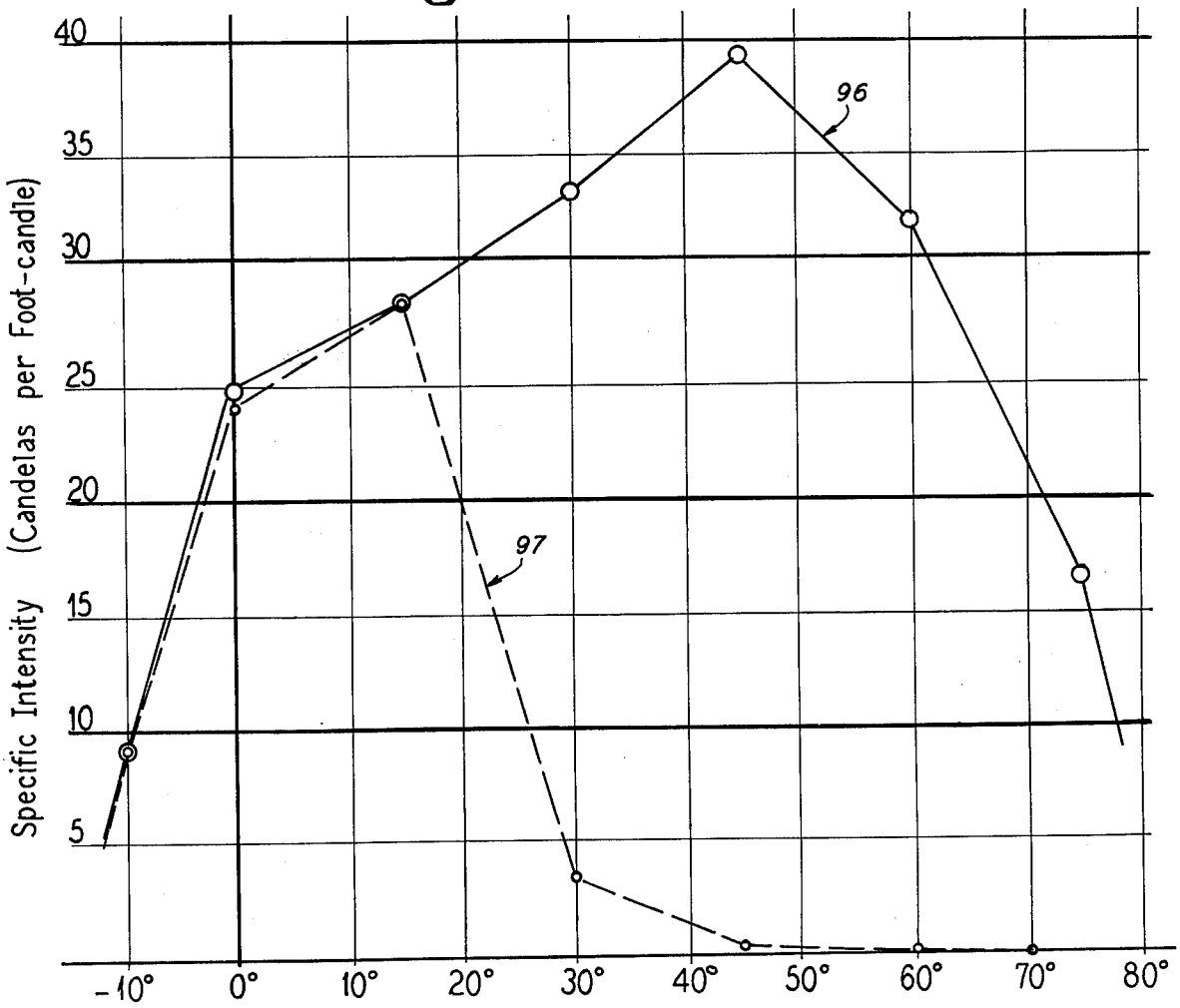
FIG. 16 is a plot in rectangular coordinates showing the characteristic relationships between specific intensity in candela per foot candle versus viewing angle at various viewing angles for two different respective barrier markers, one thereof being of the prior art.

Representative tests showing the relationship between specific entrance angles and specific intensity in candelas per foot candle are shown for the representative curves in FIG. 16. In FIG. 16 curve 96 is representative of that associated with a preferred type of embodiment for a reflector 60. Curve 97 is representative of that associated with the prior art reflector 40. As shown in FIG. 16, reflector 40 characteristically produces only effective retroreflectance up to an angle of about 30° out into a roadway from a mounted position tangent to and adjacent the roadway under conditions of observation equivalent for each of respective curves 96 and 97.

The respective curves of FIGS. 8 and 16 also illustrate the importance of having individual retroreflective reflectors used in the practice of the system of the present invention have minimum specific intensity values for retroreflectivity. Values below those herein indicated can result in the driver of an on-coming vehicle not being able to see individual reflectors, particularly in the case of inclement weather, or possibly in a situation where a slight film of atmospheric contamination (dirt) has become lodged over the face of the reflector, such as can and routinely does occur under actual field use conditions for barrier marker reflectors, as those skilled in the art will appreciate.

When one employs in the practice of the invention a reflector, such as a reflector 60, unusual and beneficial effects can result in terms of increased roadway safety. Thus, when as shown, for example, in FIG. 3 reflector 60 are mounted perhaps at intervals of say 10 to 30 feet apart along the edge portions of a highway, depending on whatever the local or regional specifications of a given highway department are, a driver of a vehicle proceeding down the road tends to experience a tunnel effect. The situation is as though the driver is moving down a lane marked on either side by a continuous pattern of retroreflected light so that the driver can see an individual reflector as one of a series of reflectors from the time that his headlights come into contact with the retroreflective surface portions of the reflector until the time when the vehicle has moved to an angle which is in the range, as discussed above, from about 60° to 85° with respect to the reflector.

In contrast, in the case of prior art reflectors, the individual reflectors are down to a negligible value for retroreflectance at angles beyond about 30° with respect to a car moving down the roadway so that such a tunnel effect is not achieved by the practice of the prior art.

In the case of a curved road, the advantages of the system of the invention are, perhaps, even more readily appreciated. Thus, approaching a curve, a driver sees reflectors of the type utilized in the present invention at a distance. Each one of the reflectors seen has a different angle of entrance, the exact angle of entrance for any given reflector depending upon the radius of curvature at the location of an individual reflector. Thus, for example, upon entering lane 31' (referring to FIG. 3), a driver may be viewing a reflector 60A at an angle of 10° while further along the curve the driver sees another reflector 60B at an angle of say 30° and still farther along another reflector 60C at an angle of say 45° and still further on another reflector 60D at an angle of 60° possibly still another reflector at an angle of 80° designated **60*e*. Now, with a reflector 60**, since such reflectors are actively retroreflective through all of these angles, one sees the complete curve ahead at the time one approaches the curve as the driver of a vehicle. In the case of the prior art, the reflectors fail to operate beyond about 30° at a maximum independently of the type of reflector use, so that the definition of the curve was lost as soon as the driver approached that curve at an angle of greater than 30° which meant that the driver was seeing only a portion of the curve and then nothing beyond that.

Figure 9:
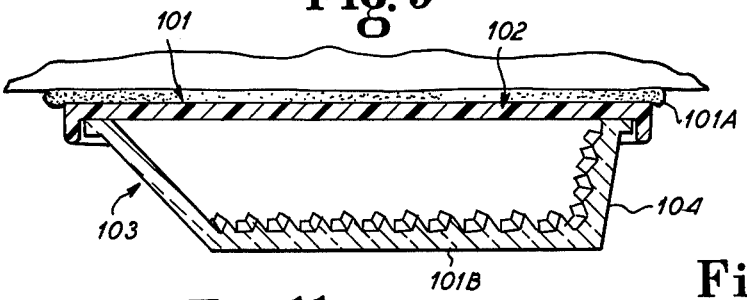
FIG. 9 is a sectional view similar to FIG. 6 but showing an alternative embodiment of a barrier marker of the present invention.
Figure 10:
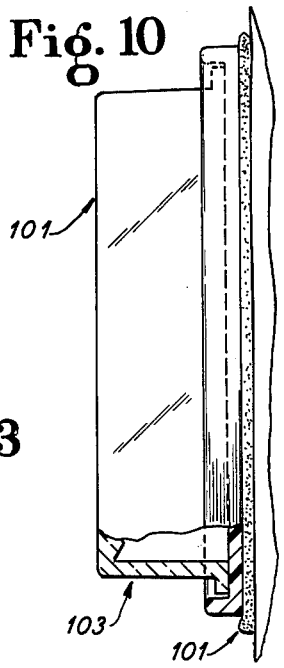
FIG. 10 is an elevational view similar to FIG. 5 but illustrating the embodiment shown in FIG. 9.

In place of reflector 60 one can employ other forms of retroreflective reflector means which have characteristics such as are generally above indicated. Thus, referring to FIGS. 9 and 10, there is seen another embodiment of a reflector construction suitable for use in the practice of this invention, such construction being designated in its entirety by the numeral 101. Reflector construction 101 is provided with a backing member 102 of integral one piece rigid construction and including a base portion which is flattened and an upstanding peripherally extending flange portion. The backing member 102 is here comprised of a molded plastic member, but could be comprised of sheet metal, or the like, as desired.

Reflector construction 101 incorporates a single three-primary sided retroreflective body 103 whose upper face has molded thereinto wide angle type cube corner retroreflective units analogous to those formed in flattened inner face 54 of body 49. A front wall portion 104 of body 103 has integrally molded thereinto standard type cube corner retroreflective units analogous to those formed in the inner face 56 of flattened body 51. The reflector construction 101 is conveniently provided with a construction terminating in an inhesive outer layer 101A analogous to that employed for the reflector 60. The angular relationships described above in reference to reflector 60 are similarly applicable to reflector 101, as those skilled in the art will appreciate. The face 101B opposed to layer 101A may have formed thereon two different groups of wide angle cube corner elements, as shown.

Figure 11:
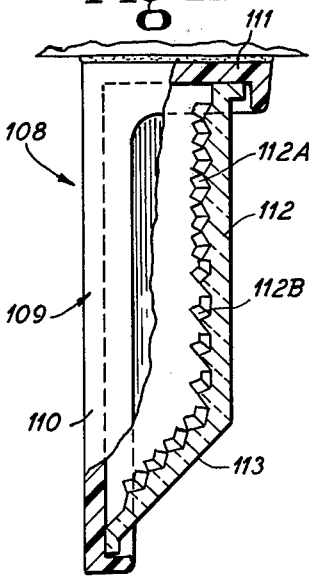
FIG. 11 is a partial sectional view similar to FIG. 6 but showing a further alternative embodiment of a barrier marker of the present invention.

Another reflector construction 108 is shown in FIG. 11 which will produce a reflected pattern of light similar to that achieved with a reflector 60. Reflector 108 employs a backing member 109 that includes a base member 110 and an integral upstanding leg member 111. The reflector construction 108 has reflective body 112 integrally formed with a reflective body 113. Body 112 has formed therein two classes of cube corner type retroreflective units 112A and 112B, while body 113 has formed therein another class of such units.

The angular performance described above in reference to reflector 60 is similarly applicable to reflector 108 by employing a suitable orientation for the optical axes of the respective classes of cube corner units in bodies 112 and 113.

Figure 13:
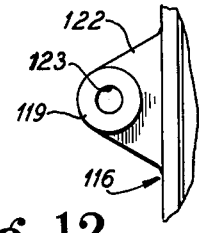
FIG. 13 is a fragmentary elevational view of the embodiment of FIG. 12 showing the mounting means used in such embodiment.
Figure 12:
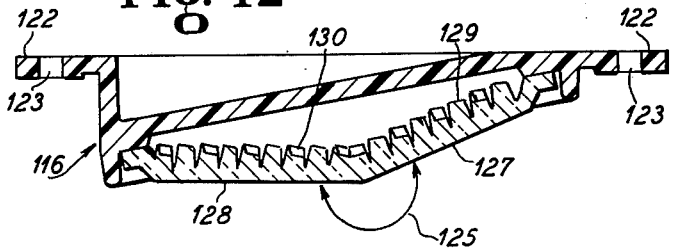
FIG. 12 is a sectional view similar to FIG. 6 but illustrating a still further embodiment of a barrier marker of the present invention.

Referring to FIGS. 12 and 13 there is seen an embodiment of a reflector construction 116 which is similar to construction 101. Reflector 116 employs a mechanical mounting means. Thus, outwardly extending mounting flanges 112 (paired), each one at a different end of reflector 116, terminate in thickened apertures 123 (one in each flange 122). A rivet, nut and bolt assembly, or the like, (not shown) can then be extended through each flange 122 to mount reflector 116 as desired. Reflector 116 employs an integrally formed pair of retroreflective surfaces 127 and 128 both containing cube corner type retroreflective units 129 and 130 molded thereinto. Units 129 can have their respective optical axes inclined at an angle of about 35° relative to a perpendicular to face 127, while units 130 can have their respective optical axes inclined at an angle of about 30° relative to a perpendicular to face 128, for example. The combination of retroreflective performance from each of said faces 127 and 128 results in a wide angle zone of retroreflectivity of from about 0° to 60°. Face 127 is inclined at an angle 125 of about 200° to 210°.

Figure 14:
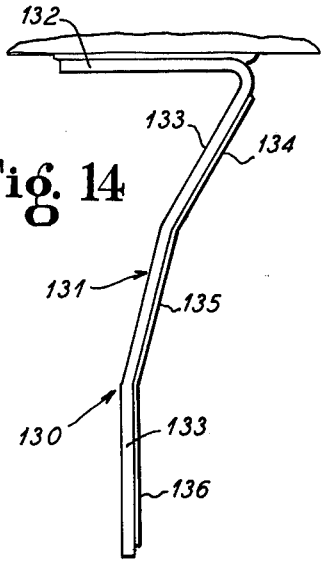
FIG. 14 is a plan view of a barrier marker embodiment usable in the practice of the present invention which employs retroreflective glass beaded sheeting.
Figure 15:
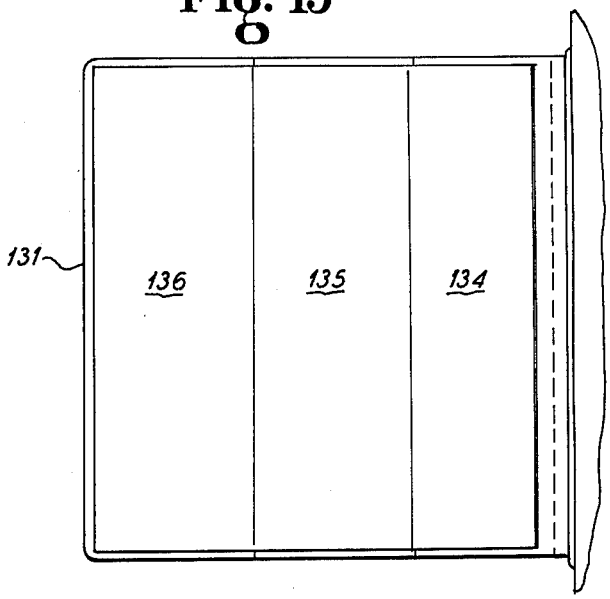
FIG. 15 is a front elevational view of the embodiment shown in FIG. 14.

Still another type of reflector construction adapted for use in the practice of the present invention is shown in FIGS. 14 and 15 and is designated in its entirety by the numeral 131. Reflector construction 131 employs a backing member 130 which incorporates integrally a mounting leg 132 and an arm 133. Arm 133 has three flattened facial regions 134, 135, and 136. On each exterior forward surface of respective regions 134, 135, and 126 is mounted a sheet of material having incorporated thereinto a plurality of glass beads, such a sheet being one of the type available commercially under the trademark "Scotch Light" or the like from Minnesota Mining and Manufacturing Company, St. Paul, Minn. The three resulting sheet coated faces 134, 135, and 136 provide a continuous distribution of retroreflected light through the range of from about 0° to 60° as desired. By using respective areas for faces 134, 135, and 136 which are sufficient to produce minimum specific intensity values for achieving the desired minimum candela per foot candle values above indicated for white cube corner type systems, reflector constructions are producable which are adapted for use in the practice of the present invention.

Figure 17:
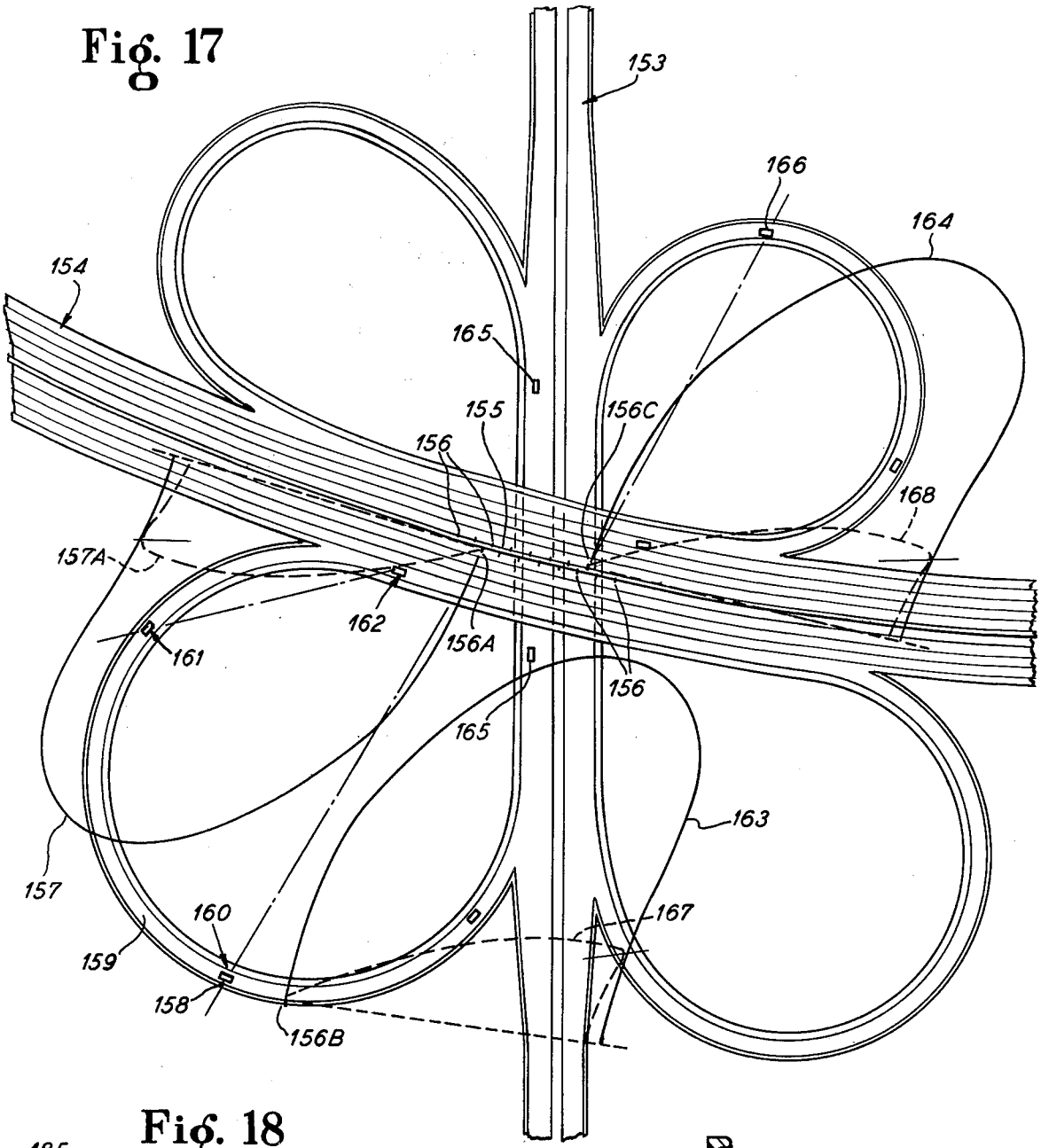
FIG. 17 is a diagrammatic plan view of an actual embodiment of the present invention.

Referring to FIG. 17, there is seen an actual installation of a systm of this invention which involves highway 53 and Palatine Road northwest of Chicago, Ill.; highway 53 being designated by the numeral 154 and Palatine Road being designated by the numeral 153. Reflectors each similar to reflector 60 are mounted on highway 154 on either side of the bridge abutment 155 each at a distance of about 30 inches vertically above the highway 154 surface. These reflectors are longitudinally spaced from one another successively at intervals of about 30 feet. There are 9 such reflectors on one side of the abutment 155 and 12 such reflectors on the opposing side thereof. For convenience here, these reflectors are each marked with a dash mark and designated by the number 156. Thus, the drivers of vehicles moving in opposed directions along highway 154 see the individual reflectors 156 at night time on their respective sides of the bridge abutment 155; each reflector 156 is viewable within an angle extending from about −15°0 to about +75°, as these angles are explained above, with 0° being a tangent to the highway 154.

Trace 157 is representative of retroreflectance from a single reflector 156A. The driver of a vehicle 158 entering highway 154 on cloverleaf 159 sees reflector 156A commencing at position 160. Such driver continues to see such reflector 156A thereafter continuously until the vehicle enters highway 154 and has almost moved past such reflector 156A. In contrast, when prior art reflectors, such as a reflector 40, replaces reflector 154A, a trace 157A results, so that the same driver then does not see such reflector 40 until, on cloverleaf 159 he reaches location 161 at which location 161 such prior art reflector 40 becomes retroreflectively visible to him. Also such driver loses sight of such reflector 40 well back of the reflector 40 at position 162 at which location 162 loses its retroreflectivity relative to such driver. There is thus a dramatic difference between these two reflectors. Obviously, all the other reflectors 156 are likewise each visible through a greatly expanded viewing angle compared to the prior art.

Traces 163 and 164 similarly show the advantage of the present invention over the prior art in reference to for example, the driver of a vehicle 165 in relation to the trace 163, or, for another example, the driver of a vehicle 166 relative to the trace 164. The dotted lines 167 and 168 illustrate respective traces for prior art reflectors such as reflector 40 replacing reflectors 156B and 156C, respectively.

Figure 18:
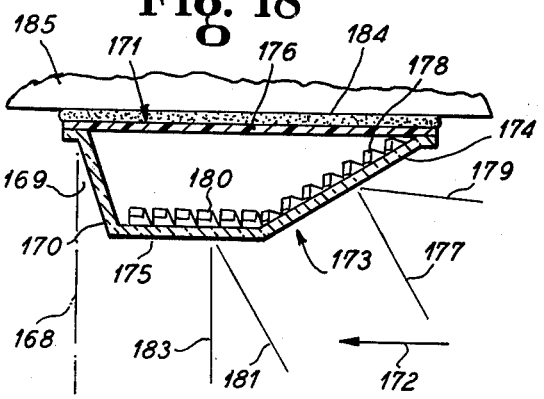
FIG. 18 is a sectional view similar to FIG. 6 but showing an alternative embodiment of a barrier marker of the present invention.

The reflector shown in FIG. 18, which is designated in its entirety by the numeral 171 may be regarded as an improved version of the prior art reflector shown in FIG. 2, the improvements being such as to render the resulting reflector 171 adapted for use in the practice of the present invention. The tangential or 0° direction along which a vehicle would move past an individual such reflector 171 in a system of this invention is marked by the arrow 172. The reflector 171 is comprised of a molded reflector body 173 having an integral front face 174 and an integral top face 175. A back face 170 is also integral with body 173 which face 170 is flat and inclined at an angle 169 of preferably about 20° relative to a perpendicular 168 to back plate 176 which angle 169 is employed for ease in molding and complete the construction. Note that surface 169 has no optical function. Body 173 is bonded to a back sealing plate member 176. A perpendicular 177 to front face 174 is used to illustrate and demonstrate the circumstance that the back of front face 174 has formed (molded) thereinto a plurality of cube corner type retroreflective units 178 which have their respective individual cube axes (illustrated by line 179) all identically aligned at an angle of from about 30° to 40° with 35° being preferred relative to perpendicular 177. The front face 174 is inclined to the tangent line 172 at an angle of from about 25° to 35° with 30° being preferred.

In reflector 171, the top face 175 has molded into its back a plurality of cube corner type retroreflective units 180 which have their respective individual cube axes (illustrated by line 181 all identically aligned at an angle of from about 25° to 35° with 30° being preferred relative to a perpendicular 183 to top face 175. The units 180 provide added angled reflector cubes for improved wide angle signal retroreflectance. Top face 175 is substantially parallel to tangent 172. An adhesive layer or tape 184 is spread over the member 176 to permit reflector 171 to be mounted upon a substrate 185 as a barrier marker for use in the practice of the present invention. The reflector 171 extends the region of retroreflectivity possessed by reflector 40 from about +25° to about +80° and the minimum specific intensity values for retroreflectivity of a reflector 171 are chosen so as to be in accord with Table I.

Figure 19:
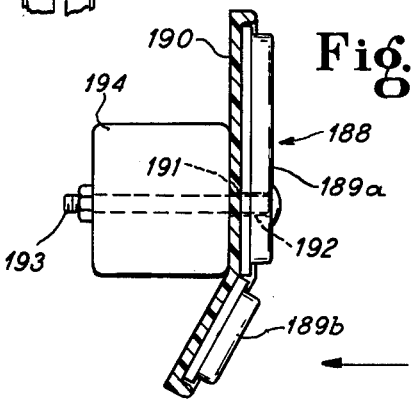
FIG. 19 is a sectional view similar to FIG. 6 but showing an alternative embodiment of a barrier marker of the present invention.

The reflector 188 shown in FIG. 19 in performance is similar, for example, to that shown in FIG. 11 and designated reflector 109. Reflector 188, however, employs separately formed retroreflective bodies **189*a* and 189*b* which are each mounted upon a single backing plate 190. An aperture 191 and an aperture 192 which are preformed in the respective plate 190 and body 189*a* and which are aligned in the assembled reflector 188 provide a means for mounting reflector 188, as by means of a nut and bolt arrangement 193 to a post 194 or the like. Bodies 189*a* and 189*b* are conveniently welded sonically to plate 190**.

A reflector used in the present invention has at least two retroreflective regions because of the need to achieve in a small area a minimum specific intensity value for retroreflectivity as indicated above (see Tables I, II and III). Preferably, the total surface area of retroreflectivity associated with a reflector used in this invention is under about 20 square inches, and more preferably under about 8 square inches.

A reflector used in the present invention should not retroreflect beyond about 90°, all as described herein, because, beyond 90° the retroreflected signal is entering the zone of a driver possibly driving in the wrong direction, against oncoming traffic, whereby the retroreflected signal would falsely indicate that he is driving in a correct direction. Thus, a marker which permits a signal in the wrong direction (beyond 90° to the tangent to the roadway) would create more of a hazard than the absence of a marker completely.

Although the teachings of our invention have herein been discussed with reference to specific theories and embodiments, it is to be understood that these are by way of illustration only and that orders may wish to utilize our invention in different designs or applications.

We claim:

1. In a roadway construction of the type having generally longitudinally extending road surface portions within roadside edge portions, the improvement which comprises (A) a plurality of individual retroreflective reflector means, each individual one of said reflector means
(1) having at least two regions which are each retroreflective of incident light, and each such region has one flattened exterior surface portion which respective such surface portions are inclined relative to one another,
(2) said two regions thereof being colored white, red, amber, or blue,
(3) said two regions thereof together further being continuously retroreflective of incident light rays striking the surface portions thereof over a predeterminable included angle of at least about 60° but less than 90° measured relative to said one flattened surface portion,
(4) the retroreflected light from any one of said reflector means at any given location within such included angle thereof having a minimum specific intensity value for retroreflectivity which is at least that shown in the following table:

| Color of said regions | Specific intensity in candelas per foot candle |
|---|---|
| white | 20 |
| red | 5 |
| amber | 12 |
| blue | 5 |

(B) a plurality of mounting means, each one being associated with a different one of said reflector means, for holding its associated individual such respective reflector means in a predetermined orientation relative to said roadside edge portions such that
(1) said flattened surface portions of each of said two regions are generally vertical, and
(2) 0° extends substantially parallelly to a tangent to said roadside edge portions in the region where each respective one of said reflector means is located, and the angle of 60° of retroreflectivity extends out into said road surface portions in a prechosen direction relative to a given direction of traffic flow along said road surface portions, (C) the relationship between individual ones of said reflector means as so held by individual ones of said mounting means being such that said reflector means are in longitudinally spaced relationship to one another relative to said roadside edge portions, and also each one of said reflector means is located relative to said road surface portions in a similar position relative thereto, and (D) the interrelationship between such plurality of reflector means and said road surface portions being such that the driver of a vehicle moving along said road surface portion at night, said vehicle being equipped with head light means, continuously sees each individual reflector means of said plurality within a viewing angle of at least from 0° to 60° but less than about 90° where 0° and 60° are as defined above.

2. The construction of claim 1 wherein said one region contains cube corner type retroreflective members.

3. The construction of claim 2 wherein each reflector means incorporates two flattened retroreflective surface portions in said one region, one of said surface portions being angularly inclined with respect to the other one thereof.

4. The construction of claim 3 wherein said one surface portion is inclined at an angle of from about 60° to 85° with respect to the other thereof.

5. The construction of claim 3 wherein one of said surface portions has positioned therebehind cube corner retroreflective units whose axes are parallel to one another and which extend at an angle of from about 20° to 35° with respect to a perpendicular to said one surface portion.

6. The construction of claim 5 wherein the other of said surface portions has positioned therebehind cube corner retroreflective units whose axes are parallel to one another and which extend at an angle of from about 0° to 15° with respect to a perpendicular to said other surface portion.

7. The construction of claim 1 wherein each said reflector incorporates only one said region and has only one said flattened surface portion.

8. The construction of claim 1 wherein said mounting means comprises a substantial vertical surface.

9. The construction of claim 8 wherein said fastening means comprises an adhesive.

10. The construction of claim 8 wherein said fastening means comprises mechancical means.

11. A reflector for improved roadside barrier marking comprising (A) a backing member of integral, one piece, rigid construction having
(1) a base flattened portion
(2) an upstanding flattened leg portion along one edge of said base portion which is inclined in relation to said base portion at an angle ranging from about 60° to 85°

(B) two molded transparent flattened bodies, each having a flattened outerface and an inner face with a plurality of cube corner type retroreflective units formed thereinto and further having an inturned peripheral shoulder which extends beyond its associated inner face,
(1) one of said flattened bodies being larger than the other thereof and being adapted to fit against the inside face of said base portion with the edge portions of said shoulder thereof engaged there-against,
(2) and other flattened body being adapted to fit against the inside face of said leg portion with the edge portions of said shoulder thereof engaged there-against, and (C) bonding means adhering such respective shoulder edge portions to said backing member at such locations of engagement, (D) said flattened bodies in combination with said backing member being adapted to retroreflect incident light rays striking said outer faces thereof within an angle of about 60° where 0° is taken along a hypothetical line which is generally parallel to the outer face of said one flattened body and which is generally perpendicular to the outer face of said other flattened body and where 60° is measured vertically upwards, from said 0° line and outwardly from the outer face of said one flattened body.

12. The reflector of claim 11 wherein said backing member has an integral upstanding rib member on opposed sides thereof with inside faces of said leg portion and said base portion being adjacent thereto.

13. The reflector of claim 11 wherein the cube corner type retroreflective units formed in said one flattened body have axes which are parallel to one another and which are inclined with respect to the outer face thereof at an angle of from about 25° to 35°.

14. The reflector of claim 11 wherein the cube corner type retroreflective units formed in said other flattened body have axes which are parallel to one another and which are inclined with respect to the outer face thereof at an angle of from about 0° to 15°.

15. The reflector of claim 11 wherein the respective said edge portions of each said flattened body is flattened and expanded laterally.

16. The reflector of claim 11 wherein said base portion has an upstanding rib member on the forward open edge thereof.

17. The reflector of claim 11 wherein said base portion has the back face thereof provided with an adhesive layer.

18. The reflector of claim 17 wherein said adhesive layer is an epoxy resin.

19. The reflector of claim 17 wherein said adhesive layer is a butyl rubber type adhesive which is activatable with a catalyst.

20. The reflector of claim 17 wherein said adhesive layer is a rubber based permanently tacky type adhesive.

21. The reflector of claim 17 wherein an elastomeric layer is interposed between said adhesive layer and said back face, and bonding means secures said elastomeric layer to said back face.

* * * * *